US007313881B1

(12) United States Patent
Gieseke et al.

(10) Patent No.: US 7,313,881 B1
(45) Date of Patent: Jan. 1, 2008

(54) PNEUMATIC LAUNCHER SYSTEM AND METHOD FOR OPERATING SAME

(75) Inventors: Thomas J. Gieseke, Mystic, CT (US); Nicholas Bitsakis, Seekonk, MA (US); Benoit G. Gauthier, Little Compton, RI (US); Robert Kuklinski, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 227 days.

(21) Appl. No.: 10/985,082

(22) Filed: Nov. 8, 2004

(51) Int. Cl.
*F41C 9/06* (2006.01)
*F41B 11/00* (2006.01)
*F41A 23/00* (2006.01)

(52) U.S. Cl. ..... 42/1.14; 124/56; 124/71; 89/37.01; 114/238

(58) Field of Classification Search ..... 42/1.14; 124/56, 61, 71; 86/50; 89/37.01; 114/238
See application file for complete search history.

(56) References Cited

U.S. PATENT DOCUMENTS 3,422,808 A * 1/1969 Weinberg et al. ..... 124/61
3,428,037 A * 2/1969 Sacerdote et al. ..... 124/61
3,448,750 A * 6/1969 Parks ..... 137/14
3,532,375 A * 10/1970 Heartness ..... 294/61
4,444,085 A 4/1984 Dragonuk
5,109,750 A 5/1992 Kayaian
5,134,921 A * 8/1992 Breed et al. ..... 86/50
5,230,324 A * 7/1993 Van Horssen et al. ..... 124/61
5,365,913 A 11/1994 Walton
5,460,154 A 10/1995 Mattern et al.
5,743,246 A * 4/1998 Mattern ..... 124/56
5,785,038 A * 7/1998 Mattern ..... 124/56
6,170,477 B1 1/2001 Horlock
6,604,518 B1 * 8/2003 Sanford et al. ..... 124/56

* cited by examiner

*Primary Examiner*—Michael J. Carone
*Assistant Examiner*—Bret Hayes
(74) *Attorney, Agent, or Firm*—James M. Kasischke; Michael P. Stanley; Jean-Paul A. Nasser

(57) ABSTRACT

A pneumatic launcher has a plenum chamber section, an intermediate chamber section and a launch tube section connected together in a generally linear arrangement. The plenum chamber section defines a plenum chamber that has a closed end and an open end. The intermediate chamber section has aft and forward rupture disks consecutively arranged to define an intermediate chamber. The plenum chamber is pressurized with a pressurized gas to a design plenum pressure and the intermediate chamber is pressurized with a pressurized gas to pressure that is about one-half the design plenum pressure. The intermediate chamber is then depressurizing to produce a pressure imbalance between the plenum and intermediate chambers that causes said aft and forward rupture disks to rupture. As a result, pressure equilibrium occurs between the plenum chamber and launch tube thereby discharging the fluid and projectile from the interior of the launch tube.

20 Claims, 3 Drawing Sheets

PNEUMATIC LAUNCHER SYSTEM AND METHOD FOR OPERATING SAME

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention generally relates to a pneumatic launcher apparatus.

2. Description of the Prior Art

Supercavitating underwater vehicles and projectiles are known in the art. One such supercavitating underwater projectile is described in Harkins et al. U.S. Pat. No. 5,955,698. Typically, such supercavitating underwater vehicles and projectiles are launched by a launcher system. The launcher for a supercavitating vehicle must meet several important requirements. Specifically, the launcher must achieve the necessary exit velocity for the selected vehicle or projectile design. The launcher must be of an economically efficient design. Preferably, the launcher should utilize a non-explosive, non-hazardous energy source and be capable of remote firing. Furthermore, the launcher must be configured to facilitate easy assembly and disassembly for maintenance and repair. It is also preferable that the launcher does not contain any components that exceed 1000 lbm (pounds mass). Another important requirement is a relatively short launch-ready time, preferably in the order of 3 hours including plenum chamber recharge time. Furthermore, the launcher should be designed for being submerged or immersed in water for extended periods of time, e.g. 24 hours.

The prior art discloses several devices and systems for launching projectiles or other objects. Dragonuk U.S. Pat. No. 4,444,085 discloses a pneumatic launch system for an aircraft for ejecting sonar buoys. Kayaian U.S. Pat. No. 5,109,750 discloses a closed-breech missile and weapon system for infantry in anti-armor or anti-personnel applications. Walton U.S. Pat. No. 5,365,913 discloses a rupture-disk gas launcher to launch a projectile toward a target. The launcher uses a source of compressed air to launch the projectile. Mattern et al. U.S. Pat. No. 5,460,154 discloses a pneumatic gun for propelling a projectile substance. This pneumatic gun is used for disarming explosive devices. Horlock U.S. Pat. No. 6,170,477 discloses a pneumatic spear gun. None of these prior art patents discloses a launcher for a supercavitating vehicle that meets the important requirements set forth in the foregoing discussion.

SUMMARY OF THE INVENTION

It is therefore an object of the present invention to provide a launcher apparatus for launching a supercavitating vehicle or projectile that meets the requirements described in the foregoing discussion.

It is another object of the present invention to provide a launcher apparatus that is inexpensive to manufacture, implement and maintain.

Other objects and advantages of the present invention will be apparent from the ensuing description.

Thus, the present invention is directed to a pneumatic launcher for use with high-speed projectiles or supercavitating underwater vehicles. In one embodiment, the pneumatic launcher comprises a plenum chamber section, an intermediate chamber section and a launch tube section connected together in a generally linear arrangement wherein the intermediate chamber section is between the plenum chamber section and the launch tube section. A support base having upstanding support members supports the plenum chamber section, intermediate chamber section and launch tube section. The plenum chamber section defines a plenum chamber that has a closed end and an open end. The intermediate chamber section has aft and forward rupture disks consecutively arranged to define an intermediate chamber. The aft rupture disk is exposed to the open end of the plenum chamber. The launch tube section comprises a launch tube that has an open breech end. The forward rupture disk is exposed to the open breech end of the launch tube. The launch tube has an interior that is in communication with the open breech end and is sized for receiving a projectile or supercavitating vehicle. The launch tube further includes an open exit end opposite the open breech end through which a projectile or supercavitating vehicle exits from the interior of the launch tube. In one embodiment, the aft and forward rupture disks are configured to rupture at two-thirds the design plenum pressure. When the pneumatic launcher is submerged in fluid (e.g., water), the fluid floods the interior of the launch tube. In order to launch a projectile or supercavitating vehicle, the plenum chamber is pressurized with a pressurized gas to a first predetermined pressure. The intermediate chamber is then pressurized with a pressurized gas to pressure that is generally the same as the first predetermined pressure in order to achieve a state of pressure equilibrium. Next, the plenum chamber is pressurized to the design plenum pressure. Preferably, the design plenum pressure is about twice the first predetermined pressure. Next, the intermediate chamber is then depressurizing to produce a pressure imbalance between the plenum and intermediate chambers that causes said aft and forward rupture disks to rupture. Once the aft and forward disks have ruptured, pressure equilibrium occurs between the intermediate chamber and the interior of the launch tube thereby discharging the fluid and projectile or vehicle from the interior of the launch tube.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawings, in which.

DESCRIPTION OF THE PREFERRED EMBODIMENTS

Figure 1:
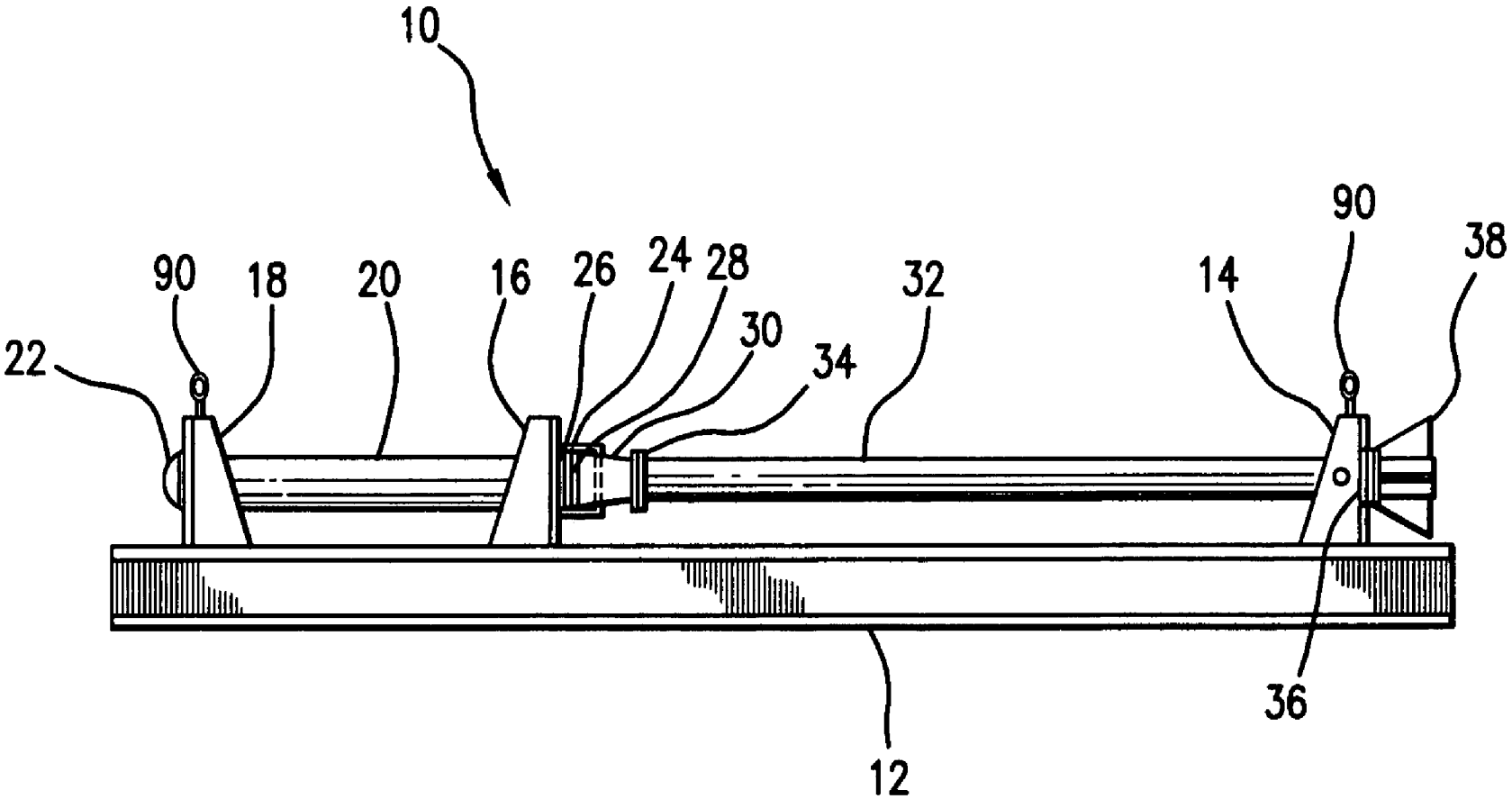
FIG. 1 is a side elevational view of the pneumatic launcher tube of the present invention.

Referring to FIG. 1, there is shown pneumatic launcher 10 in accordance with the invention. Pneumatic launcher 10 is to be used to launch supercavitating vehicles or other projectiles. As used herein, the term "projectiles" shall include supercavitating vehicles, torpedoes, sonar buoys, and other similar objects. Pneumatic launcher 10 comprises support base member 12, forward support 14, middle support 16 and aft support 18. Pneumatic launcher 10 further comprises plenum chamber 20 which is supported by middle support 16 and aft support 18. In a preferred embodiment, plenum chamber 20 is attached to middle support 16 and aft support 18. Plenum chamber 18 includes end cap 22. Pneumatic launcher 10 further comprises intermediate chamber 24 that is formed by aft rupture disk 26 and forward rupture disk 28 which are arranged in series. Pneumatic launcher 10 further includes contraction member 30, the purpose of which is described in the ensuing description. Aft rupture disk 26 and forward rupture disk 28 are configured to rupture when the pressure imbalance between plenum chamber 20 and intermediate chamber 24 reaches a predetermined pressure. This feature is discussed in the ensuing description.

Referring to FIG. 1, pneumatic launcher 10 further includes launch tube 32 that has an open breech end 34 that is connected to contraction member 30 and open exit end 36 that is opposite open breech end 34. Launch tube 32 has an interior for receiving a projectile. Open exit end 36 of launch tube 32 allows launch tube 32 to be flooded with fluid (e.g. water) when pneumatic launcher 10 is submerged under the fluid. The portion of launch tube 32 near open exit end 36 is supported by forward support member 14. The diameter of intermediate chamber 24 is larger than the diameter of launch tube 32. Therefore, contraction member 30 provides a transition from the diameter of intermediate chamber 24 to the smaller diameter of launch tube 32. Pneumatic launcher 10 further includes muzzle brake 38 which is attached to launch tube 32 and is positioned about open exit end 36. Muzzle brake 38 also abuts forward support member 14. Muzzle brake 38 minimizes the pre-launch recoil force associated with the initial discharge of fluid within launch tube 32.

Figure 2:
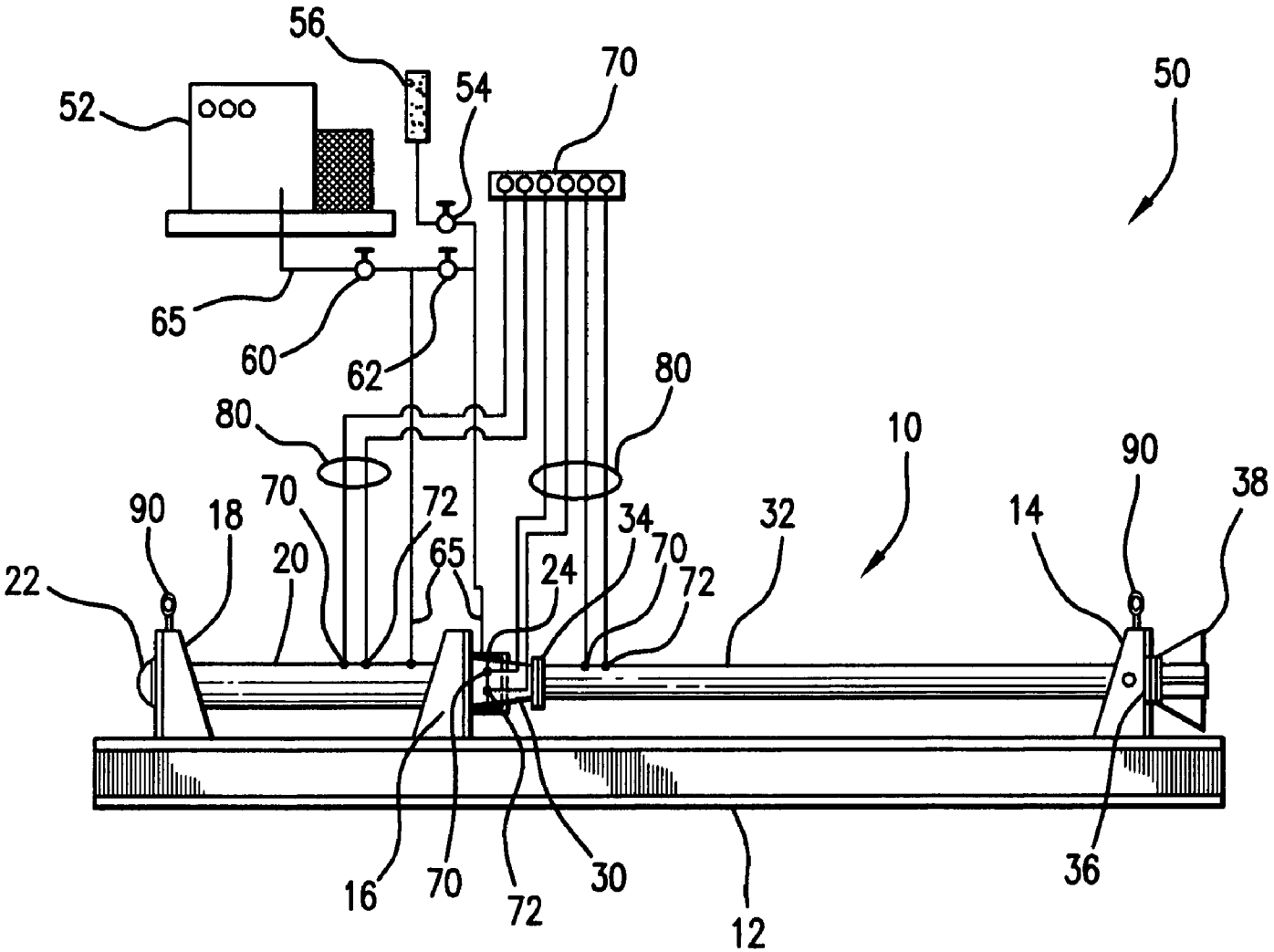
FIG. 2 is a side elevational view of the pneumatic launcher tube of FIG. 1 connected to a control system in accordance with the invention.

Referring to FIG. 2, there is shown pneumatic launcher system 50 in accordance with the present invention. Pneumatic launcher system 50 comprises pressurized gas source 52 that provides compressed air or gas that is discharged into plenum chamber 20 in order to charge pneumatic launcher 10 to the design plenum pressure. As used herein, "design plenum pressure" is the pressure to which plenum chamber 20 is pressurized in order to achieve the desired launch velocity. In one embodiment, pressurized gas source 52 comprises an air compressor. In a preferred embodiment, such an air compressor is capable of producing pressure between about 3000 PSI (pounds per square inch) and 3500 PSI. In another embodiment, pressurized gas source 52 comprises a plurality of compressed gas tanks that would be discharged into plenum chamber 20.

Referring to FIG. 1, in accordance with the invention, aft and forward rupture disks 26 and 28 each have a pressure rating that causes these rupture disks to rupture when exposed to a predetermined pressure that is less than the design plenum pressure. In a preferred embodiment, the pressure ratings of aft and forward rupture disks 26 and 28 are such as to cause these rupture disks to rupture when exposed to a pressure that is about two-thirds of the design plenum pressure.

Referring to FIG. 2, pneumatic launcher system 50 further includes a venting system that effects pressure equilibrium between plenum chamber 20 and launch tube 32 in order to launch a projectile. This venting system comprises vent valve 54 and muffler 56 and is used to vent pressurized gas from intermediate chamber 24. The purpose of this feature is described in the ensuing description. In accordance with the invention, intermediate chamber 24 is pressurized to a pressure that is less than the design plenum pressure. In a preferred embodiment, intermediate chamber 24 is pressurized to a pressure that is about one-half the design plenum pressure in plenum chamber 20 in order to prevent rupturing aft and forward rupture disks 26 and 28, respectively, prior to launching the projectile. Consequently, the pressure drop from plenum chamber 20 to intermediate chamber 24 is one-half of the design plenum pressure in plenum chamber 20, and the pressure drop from intermediate chamber 24 to launch tube 32 is about one-half of the design plenum pressure.

Referring to FIG. 2, when the pressurized gas in intermediate chamber 24 is vented with vent valve 64, the pressure to which aft rupture disk 26 is exposed increases to above its pressure rating and consequently, ruptures thereby allowing pressurized gas to flow from plenum chamber 20 into intermediate chamber 24. Consequently, the pressure to which forward rupture disk 28 increases thereby rupturing forward rupture disk 28 and completing the launching sequence. Pneumatic launcher system 50 includes main valve 60 and intermediate chamber valve 62 which control the flow of pressurized gas. Specifically, main valve 60 is connected between pressurized gas source 52 and plenum chamber 20 and controls the flow of pressurized gas from pressurized gas source 50 to plenum chamber 20.

Intermediate chamber pressure valve 62 is connected between main valve 60 and intermediate chamber 24 and controls the flow of pressurized gas into intermediate chamber 24. Pressurized gas flows throughout pneumatic launcher system 50 via pressurized gas lines or conduits 65. In a preferred embodiment, pressurized gas source 52 incorporates adequate air-drying equipment to ensure that icing does not occur within pressurized gas lines or conduits 65, or within plenum and intermediate chambers 20 and 24, respectively.

In a preferred embodiment, the ensuing steps are implemented to launch a projectile using pneumatic launcher system 50. The first step is to close intermediate chamber pressure valve 62 and venting valve 54. Next, main valve 60 is opened. Pressurized gas source 52 is then activated so as to pressurize plenum chamber 20. In a preferred embodiment, plenum chamber 20 is pressurized to a pressure that is about 75% of the pressure rating of aft rupture disk 26. Once the desired plenum chamber pressure is attained, pressurized gas source 52 is then deactivated and main valve 60 is closed. Next, intermediate chamber pressure valve 62 is opened to pressurize intermediate chamber 24. Intermediate chamber 24 is pressurized to a pressure that is substantially the same as the pressure in plenum chamber 20.

Thus, at this point in the method, plenum chamber 20 and intermediate chamber 24 are in equilibrium. Once intermediate chamber 24 is pressurized, intermediate chamber pressure valve 62 is then closed. Next, main valve 60 is then opened again and pressurized gas source 52 is activated so as to pressurize plenum chamber 20 to the design plenum pressure. In a preferred embodiment, the design plenum pressure is about twice the pressure of intermediate chamber 24. Pressurized gas source 52 is then deactivated and main valve 60 is closed. The last step is to open vent valve 54 to vent the pressurized gas from intermediate chamber 24 causing an immediate pressure imbalance between plenum chamber 20 and intermediate chamber 24. This pressure imbalance cause aft rupture disk 26 to rupture. Pressurized gas immediately rushes through intermediate chamber 24 and causes forward rupture disk 28 to rupture. As a result, pressurized gas flows into launch tube 32 causing immediate discharge of all fluid within launch tube 32 as well as the projectile.

Referring to FIG. 2, pneumatic launcher system 10 further comprises muffler 56 which reduces noise produced when venting valve 54 is opened to vent pressurized gas in intermediate chamber 24 to the atmosphere. Pneumatic launcher system 10 further includes pressure transducers 70 and temperature transducers 72 that provide transducer signals that represent the pressure and temperature within plenum chamber 20, intermediate chamber 24 and launch tube 32. These transducer signals are routed to signal conditioner 80 via wires or cables 90. Signal conditioner 80 has conversion, amplification, shaping, and filtering electronics (not shown, but known in the art) that process the transducer signals and convert these transducer signals to voltage signals of sufficient magnitude which can be used by system monitoring equipment (not shown). Hooks 90 are attached to forward and aft support members 14 and 18, respectively, to allow pneumatic launcher 10 to be lowered into a body of fluid or retrieved therefrom.

The total mass that is moved by the pressurized gas rushing into launch tube 32 from plenum chamber 20 and intermediate chamber 24 is equal to the mass of the projectile plus the mass of fluid (e.g. water) in launch tube 32. As the projectile forces fluid out of launch tube 32, the mass of the fluid in launch tube 32 decreases. The pressurized gas rushing into launch tube 32 from plenum chamber 20 and intermediate chamber 24 after rupture disks 26 and 26 rupture is sufficient to overcome launch tube exit pressures and hydrodynamic losses as fluid exits launch tube 32.

Figure 3:
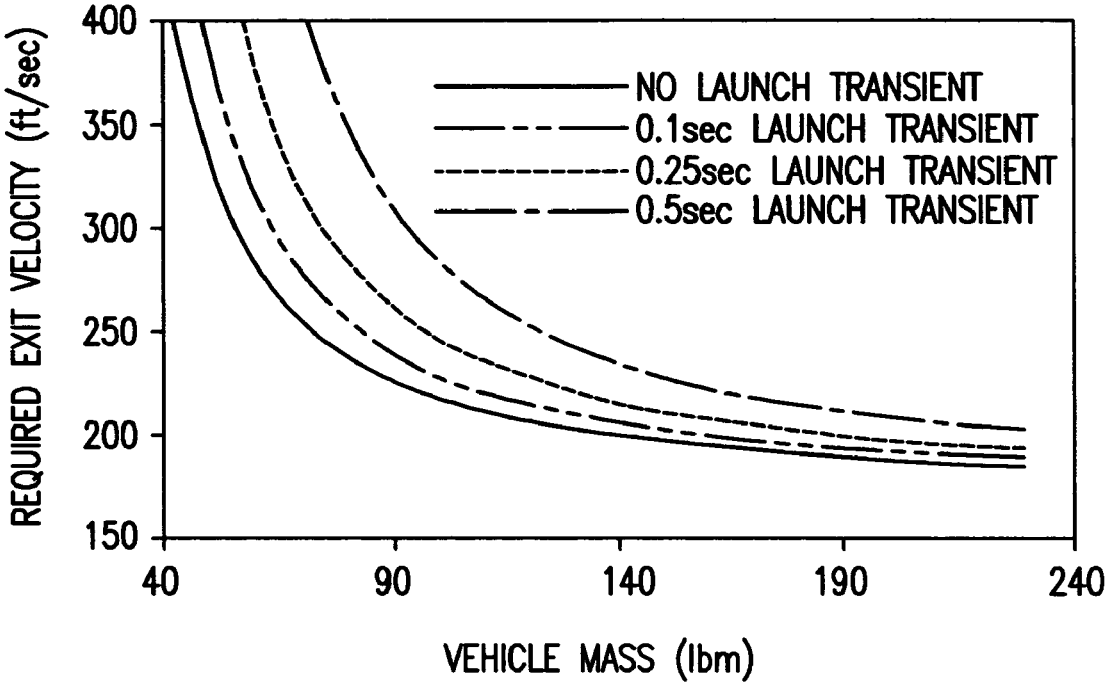
FIG. 3 is graph showing required exit velocity for a range of projectile masses and launch transient time allowances.

There is a minimum launch velocity that must be achieved for a given set of projectile or vehicle parameters (including mass), a specified data acquisition time, a specified time of flight before data acquisition begins, and a specified minimum vehicle velocity during data acquisition. FIG. 3 shows required exit velocities for a range of projectile masses and launch transient time allowances. It has been found that particular combinations of design parameters have provided several pneumatic launcher system designs, in accordance with the invention, that meet the requirements shown in FIG. 3. Table I provides examples of such pneumatic launcher system designs.

TABLE I

| Design No. | Vehicle Diameter (inches) | Vehicle Mass (lbm) | Launcher Tube Length (feet) | 8" ID Pipe Plenum Length (feet) | Plenum Pressure (psi) | Quantity Of Compressed Nitrogen Tanks/ Charge |
|---|---|---|---|---|---|---|
| 1 | 4.72 | 110 | 10.9 | 8.3 | 2020 | 2.3 |
| 2 | 4.72 | 132 | 8.0 | 9.5 | 2020 | 2.6 |
| 3 | 6.25 | 110 | 9.3 | 8.5 | 1900 | 2.7 |
| 4 | 9.00 | 110 | 15.4 | 10.0 | 1960 | 2.6 |

For example, Design No. 1 is directed to a pneumatic launcher system that is configured to launch a vehicle having a diameter of 4.72 inches and a mass of 110 lbm. The launcher tube has a length of 10.9 feet. The inner diameter of plenum chamber 20 is 8.0 inches and its length is 8.3 feet. The design plenum pressure is 2020 psi. The required number of compressed nitrogen tanks per charge (i.e. per launch) is 2.3. In Design No. 3, the pneumatic launcher system is configured to launch a vehicle having a diameter of 6.25 inches and a mass of 110 lbm. The launcher tube has a length of 9.3 feet. The inner diameter of plenum chamber 20 is 8.0 inches and its length is 8.5 feet. The design plenum pressure is 1900 psi. The required number of compressed nitrogen tanks per charge (i.e. per launch) is 2.7. It is to be understood that the pneumatic launcher system designs described in Table I are examples and that other combinations of pneumatic launcher design parameters be used to realize a pneumatic launcher system, in accordance with the invention, that meets the requirements shown in FIG. 3.

In an alternate embodiment, high speed valves can be used in place of the rupture disks 26 and 28. Furthermore, launch tube 32 can be operated as a dry launch tube wherein a thin membrane is placed over the exit end of launch tube 32 to prevent infiltration of fluid into the interior of launch tube 32. The thin membrane can easily be ruptured by the projectile as it leaves launch tube 32.

The present invention provides several important advantages. The venting system for venting intermediate chamber 24 is simple in design, does not utilize electronics or hydraulic systems, and is easy to install. Furthermore, the venting system is low cost and easily controllable. The collinear arrangement of plenum chamber 20, intermediate chamber 24, and launch tube 32 simplifies the design and the assembly of pneumatic launcher 10. Furthermore, muzzle brake 38 minimizes the pre-launch recoil force associated with the initial discharge of the fluid in launch tube 32.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the invention. Accordingly, the foregoing detailed description should be considered as exemplary in nature and not as limiting the scope and spirit of the invention as set forth in the attached claims.

What is claimed is:

1. A pneumatic launcher system comprising:

a support base member;

a plenum chamber section supported by said support base member, said plenum chamber section defining a plenum chamber having a closed end and an open end;

an intermediate chamber section connected to said plenum chamber section and having aft and forward rupture disks consecutively arranged therein to define an intermediate chamber between said aft and forward rupture disks, said aft rupture disk being exposed to said open end of said plenum chamber;

a launch tube section connected to said intermediate chamber section and supported by said base support member, said launch tube section having an open breech end, an interior in communication with the open breech end sized for receiving a projectile, and an open exit end opposite the breech end from which the projectile exits the interior, said forward rupture disk of said intermediate chamber section being exposed to said open breech end of said launch tube; and said plenum chamber section, intermediate chamber section and launch tube section being generally collinearly arranged wherein said intermediate chamber section is located between said plenum chamber section and launch tube section.

2. The pneumatic launcher system according to claim 1 further comprising a plurality of support members attached to and upstanding from said support base member, said support members supporting the plenum chamber section and launch tube section.

3. The pneumatic launcher system according to claim 2 wherein said aft rupture disk is configured to rupture when said aft rupture disk is exposed to a predetermined pressure.

4. The pneumatic launcher system according to claim 2 wherein said forward rupture disk is configured to rupture when said forward rupture disk is exposed to a predetermined pressure.

5. The pneumatic launcher system according to claim 2 further comprising a muzzle brake that is attached to said launch tube section about the open exit end of said launch tube section and abuts one of said support members to minimize pre-launch recoil forces associated with the initial discharge of fluid from said interior of said launch tube.

6. The pneumatic launcher system according to claim 1 wherein said closed end of said plenum chamber comprises an end cap.

7. The pneumatic launcher system according to claim 1 further comprising:

a pressurized gas generation source;

a conduit network in gaseous communication with said pressurized gas generation source and said plenum and intermediate chambers to introduce pressurized gas into said plenum and intermediate chambers;

a primary valve operatively connected to said conduit network to regulate the flow of pressurized gas into said plenum chamber;

a secondary valve operatively connected to said conduit network to regulate the flow of pressurized gas into said intermediate chamber; and a venting device operatively connected to said conduit network to vent pressurized gas within said intermediate chamber into the atmosphere to produce a pressure imbalance between said plenum chamber and said intermediate chamber and to cause said aft and forward and rupture disks to rupture.

8. The pneumatic launcher system according to claim 7 further comprising a muffler device to reduce noise generated by venting pressurized gas within said intermediate chamber.

9. The pneumatic launcher system according to claim 7 further comprising:

a plurality of pressure and temperature sensors that produce signals that represent the temperature and pressure within said plenum and intermediate chambers; and a processor resource to process the signals produced by said sensors.

10. A pneumatic launcher comprising a plenum chamber section, an intermediate chamber section and a launch tube section connected together in a generally collinear arrangement wherein said intermediate chamber section is between said plenum chamber section and said launch tube section, said plenum chamber section defining a plenum chamber having a closed end and an open end, said intermediate chamber section having aft and forward rupture disks consecutively arranged to define an intermediate chamber wherein said aft rupture disk is exposed to said open end of said plenum chamber, said launch tube section having an open breech end that confronts the forward rupture disk, an interior that is in communication with said open breech end and sized for receiving a projectile, and an open exit end opposite said open breech end through which a projectile exits said interior.

11. A method of operating a pneumatic launcher, comprising:

providing a pneumatic launcher comprising a plenum chamber section, an intermediate chamber section and a launch tube section connected together in a generally collinear arrangement wherein said intermediate chamber section is between said plenum chamber section and said launch tube section, said plenum chamber section defining a plenum chamber having a closed end and an open end, said intermediate chamber section having aft and forward rupture disks consecutively arranged to define an intermediate chamber wherein said aft rupture disk is exposed to said open end of said plenum chamber, said launch tube section having an open breech end that confronts the forward rupture disk, an interior that is in communication with said open breech end and sized for receiving a projectile, and an open exit end opposite said open breech end through which a projectile exits said interior;

submerging the pneumatic launcher in fluid so that fluid floods said interior of said launch tube;

pressurizing said plenum chamber to a first predetermined pressure;

pressurizing said intermediate chamber to a pressure that is generally the same as the first predetermined pressure;

pressurizing said plenum chamber to a second predetermined pressure that is greater than the first predetermined chamber; and depressurizing said intermediate chamber to produce a pressure imbalance between said plenum and intermediate chambers that causes said aft and forward rupture disks to rupture thereby equalizing the pressure between said plenum chamber and said interior of said launch tube and discharging the fluid from said interior of said launch tube.

12. The method according to claim 11 wherein said second predetermined pressure is about twice as much as said first predetermined pressure.

13. The method according to claim 11 wherein said aft and forward rupture disks each have a pressure rating that is about two-thirds the second predetermined pressure.

14. The method according to claim 11 wherein pressurizing said plenum chamber comprises introducing a pressurized gas into said plenum chamber.

15. The method according to claim 11 wherein pressurizing said intermediate chamber comprises introducing a pressurized gas into said intermediate chamber.

16. The method according to claim 15 wherein depressurizing said intermediate chamber comprises venting said pressurized gas from said intermediate chamber.

17. The method according to claim 16 further comprises muffling noise produced by said venting said pressurized gas.

18. The method according to claim 11 further comprising sensing the pressure within said plenum chamber.

19. The method according to claim 11 further comprising sensing the pressure within said intermediate chamber.

20. The method according to claim 11 wherein providing said pneumatic launcher includes positioning a projectile within said interior of said launch tube.

* * * * *